United States Patent [19]

Tokuno et al.

[11] Patent Number: 4,481,053

[45] Date of Patent: Nov. 6, 1984

[54] METHOD AND APPARATUS FOR SPLICING WEB

[75] Inventors: Masateru Tokuno, Nishinomiya; Tetsuya Sawada, Kyoto; Yoshihiro Ishii, Yao, all of Japan

[73] Assignee: Rengo Co., Ltd., Osaka, Japan

[21] Appl. No.: 431,091

[22] Filed: Sep. 30, 1982

[30] Foreign Application Priority Data

Sep. 30, 1981 [JP] Japan ..... 56-157952

[51] Int. Cl.[3] ..... B31F 5/00; B65H 19/00; B65H 69/02; G03D 15/04

[52] U.S. Cl. ..... 156/157; 156/159; 156/504; 156/505; 242/56 R; 242/58.1; 242/58.4; 242/58.5

[58] Field of Search ..... 156/517, 157, 159, 504, 156/505, 502; 242/58.5, 58.1, 58.4, 56 R

[56] References Cited

U.S. PATENT DOCUMENTS

| | | | |
|---|---|---|---|
| 4,065,067 | 12/1977 | Martinez | 242/58.1 |
| 4,106,974 | 8/1978 | Hirsch | 156/157 |
| 4,169,752 | 10/1979 | Tokuno | 156/159 |
| 4,170,506 | 10/1979 | Marschke | 156/159 |
| 4,331,301 | 5/1982 | Martinez | 242/58.1 |

*Primary Examiner*—Jay H. Woo
*Assistant Examiner*—Timothy W. Heitbrink
*Attorney, Agent, or Firm*—Wenderoth, Lind & Ponack

[57] ABSTRACT

An improved process and apparatus for splicing a new web to a running web are proposed. The old web is cut off just behind the spliced point. Therefore, no tail is left on the web spliced. The running web is nipped at two points between two pairs of rolls. Because it is tight between the two points, a clear cut is possible with a single cutting blade.

12 Claims, 36 Drawing Figures

A
B
C
D
P
P'
1
4
5
6
7
10
11
18
19
20
23
24
25
26
27
29
30
31
32
33
35
36
40
41
42
43
49
50
51
52
53

METHOD AND APPARATUS FOR SPLICING WEB

The present invention relates to a method and an apparatus for splicing the leading end of a standby web to a running web being continuously supplied from a roll, without decreasing the machine speed.

In the production of corrugated fiberboard, various methods and apparatus are known in which when the expiring web roll is running short or when the web has to be changed to another web of different quality, width or thickness, a standby web is spliced to the running web with a double-sided adhesive tape and simultaneously the running web is cut behind the spliced point, without decreasing the machine speed. If the machine were stopped or the machine speed were dropped for splicing, the amount of production would decrease and the corrugated fiberboard would discolor and/or warp because it has to stay on the hot plate for a long time.

In such conventional splicing methods and apparatus, the running web is not cut just behind the spliced point. Thus, the web spliced has a tail behind the spliced point, said tail being loose, not adhered to the new web. The corrugated fiberboard produced with the web spliced in such a manner has a decreased strength. Therefore, the spliced point has to be cut off before the corrugated fiberboard is processed to use it to make boxes or the like.

An object of the present invention is to provide a method and an apparatus for splicing web which obviate the abovementioned shortcoming.

In accordance with the present invention, the old web is cut off just behind the spliced point or along the rear edge of the double-sided adhesive tape. Therefore, no tail is left on the web after splicing, so there is no need for cutting off the spliced portions from the corrugated fiberboard any more.

In accordance with the present invention, the running web is stopped at two points by nipping it between the splice rolls and between the brake rolls. Because the web is tight between the spliced rolls and the brake rolls, a clear cut of the web is possible with a single cutting blade, whereas in the conventional splicing apparatus cutting has had to be done with a pair of cutter blades.

Other objects and advantages of the present invention will become apparent from the following description taken with reference to the accompanying drawings, in which.

Figure 1:
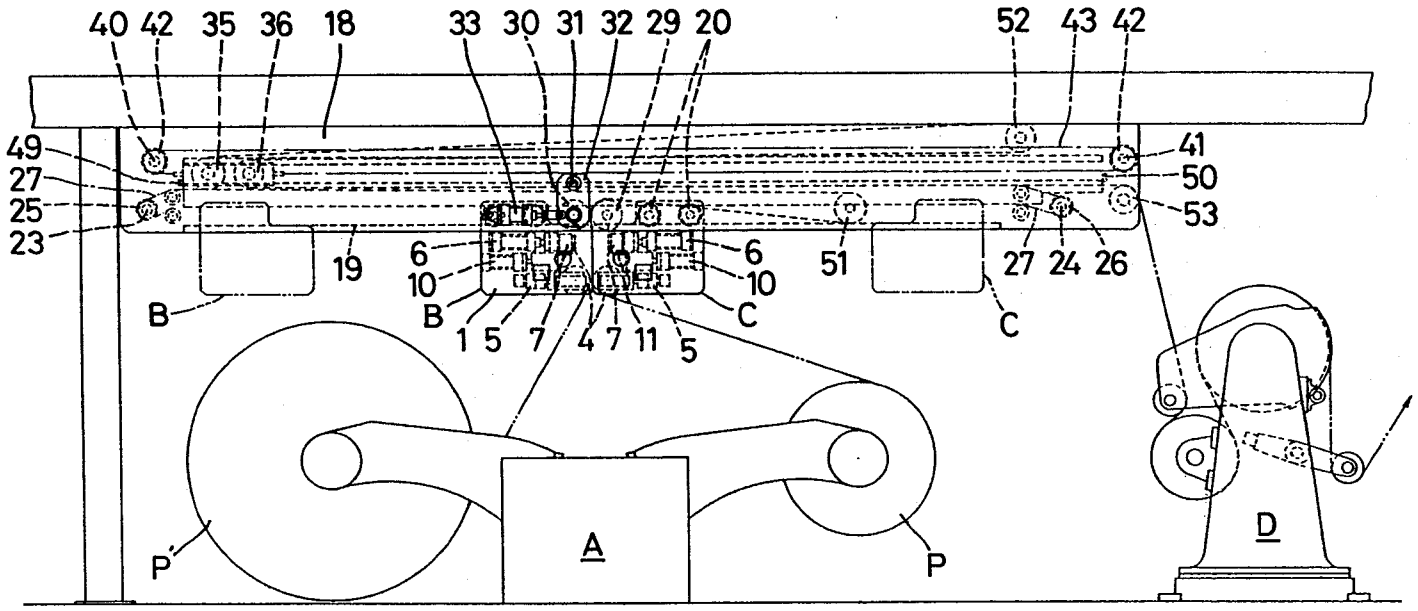
FIG. 1 is a side view of the web splicer according to the present invention.

Referring to the drawings, over a mill roll stand A for supporting rolls of web, there are provided a pair of splicing units, a left unit B and a right unit C.

Figure 2:
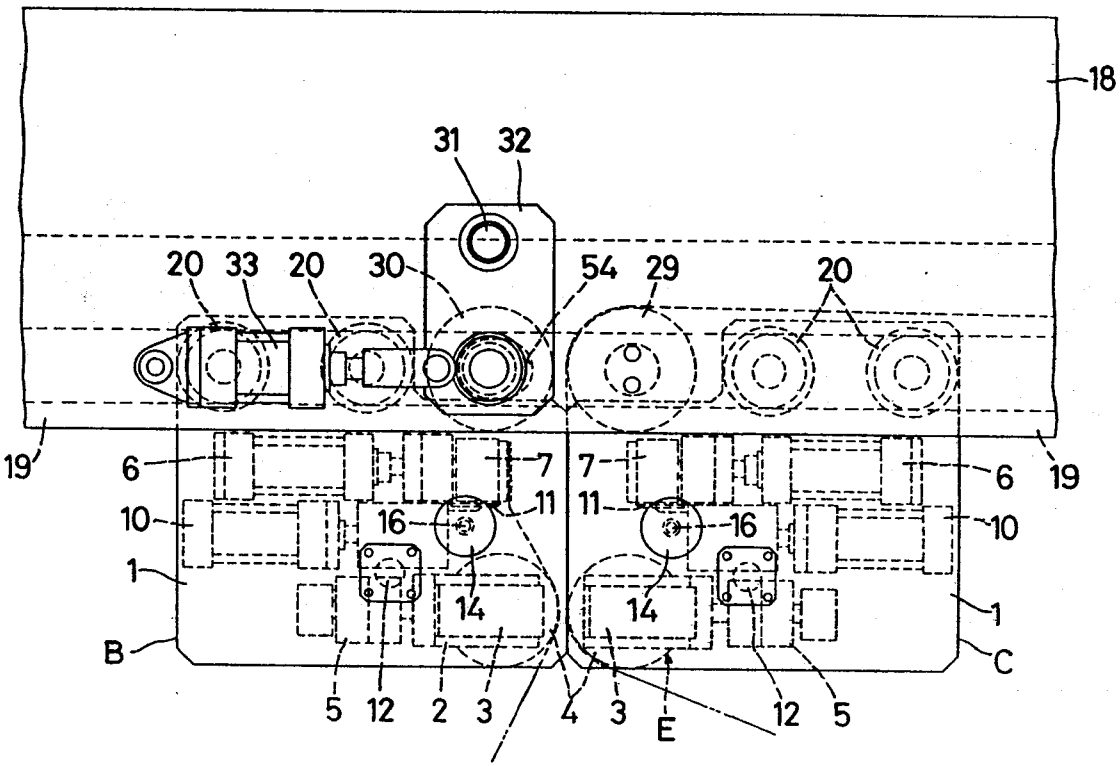
FIG. 2 is an enlarged side view of the left (and right) unit.
Figure 3:
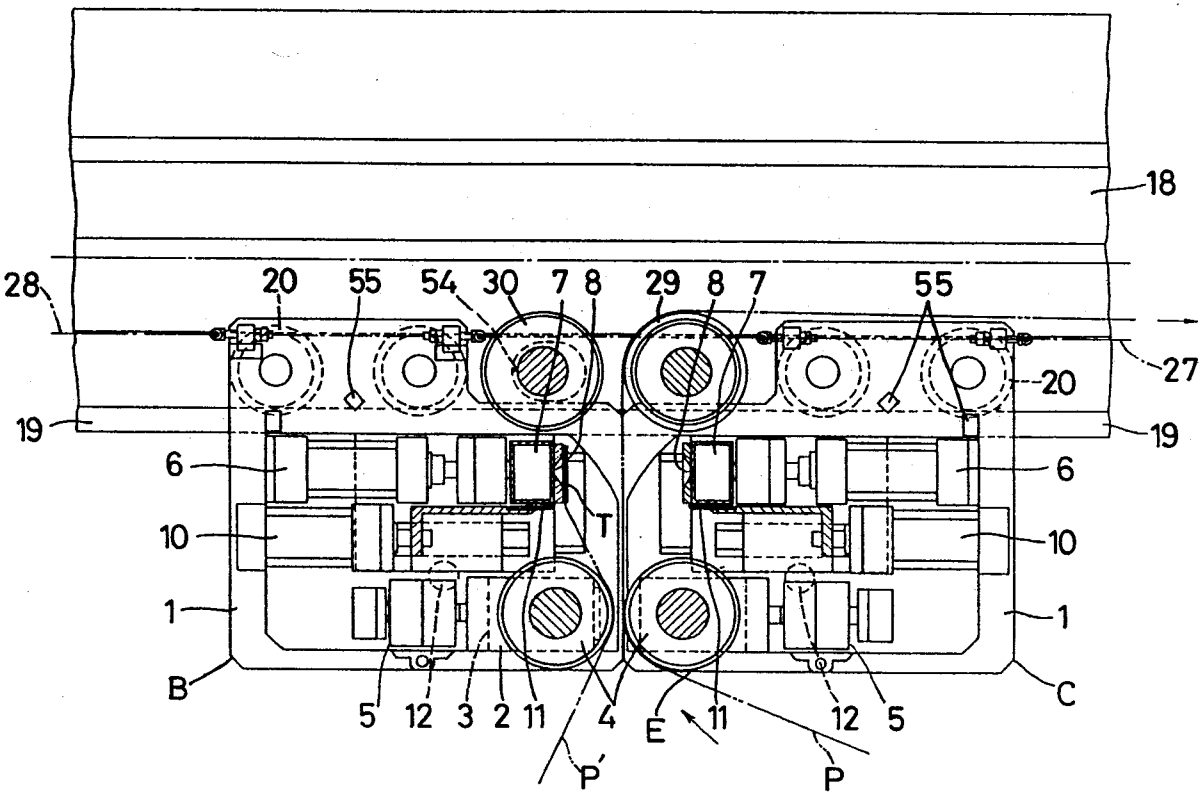
FIG. 3 is a vertical sectional side view of the same.
Figure 4:
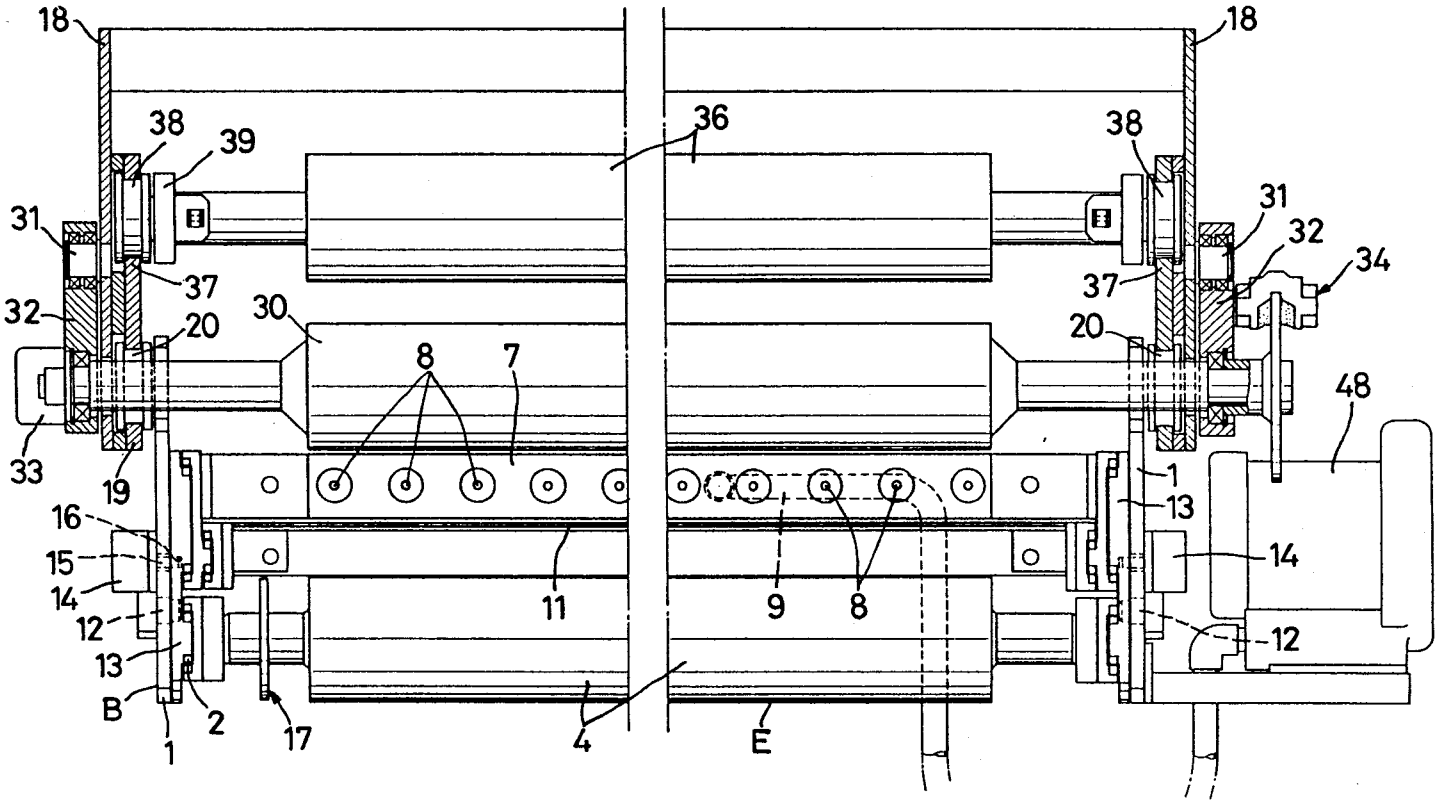
FIG. 4 is a vertical sectional front view of the same.

As shown in FIGS. 2–4, each splicing unit includes inner plates 1, a web clamp unit E disposed at the bottom thereof for stopping the running web being supplied, a hollow press member 7 provided above the clamp unit E so as to be slidable laterally by means of a cylinder 6, said press member having a plurality of suction holes 8 (FIG. 4) in its front wall, a hose 9 connected to a pump 48 to apply suction to the web through the suction holes 8, and a cutter 11 mounted under the press member 7 so as to be advanced by a cylinder 10.

The web clamp unit E comprises a horizontal rail 2, a brake roll 4 journalled by bearings 3 on the rail, and a cylinder 5 for moving the brake roll 4 laterally. The clamp unit can comprise a fixed body and a movable body adapted to be pressed against the fixed body to stop the running web.

Figure 11:
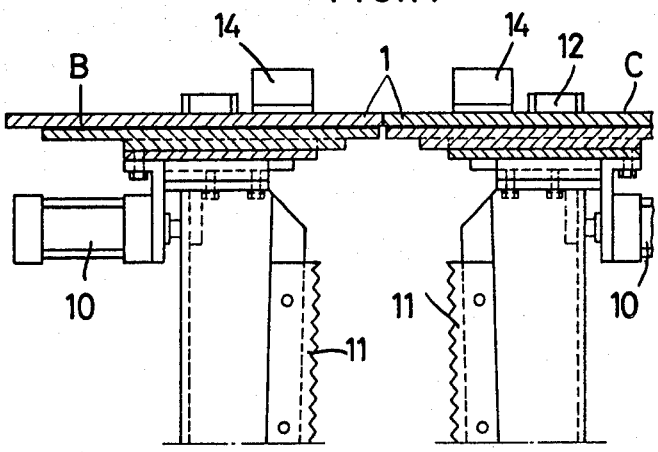
FIG. 11 is a horizontal sectional plan view of the cutter and related parts.
Figure 12:
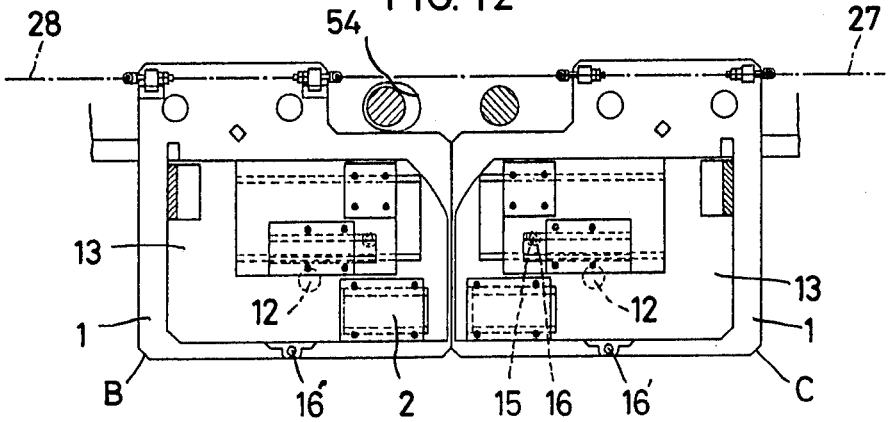
FIG. 12 is a vertical sectional side view of the frame for the right and left units.

Preferably, the cutter 11 has a saw-toothed blade (FIG. 11) to minimize the cutting resistance.

Inside of the inner plates 1 there are provided swivel plates 13 pivotable around a pivot 12. On and between the swivel plates 13 the members forming the splicing units B and C are mounted. After the units B and C have been retracted to their inoperative position, the swivel plates 13 can be pivoted (clockwise in FIG. 13) to bring the brake roll 4 to a higher position. This facilitates setting the end of the standby web on the suction holes 8 in the press member 7. The swivel plates 13 can be locked in its normal or swiveled position by extending a pin 15 by means of a cylinder 14 mounted on the inner plate into a pin receiving hole 16 or 16' in the swivel plate 13. The brake roll 4 is braked by a disc brake 17.

Since the pair of brake rolls 4 have respective cylinders 5, one brake roll is advanced into its operative position by its cylinder and the other brake roll is pressed against the brake roll by the other cylinder.

Figure 5:
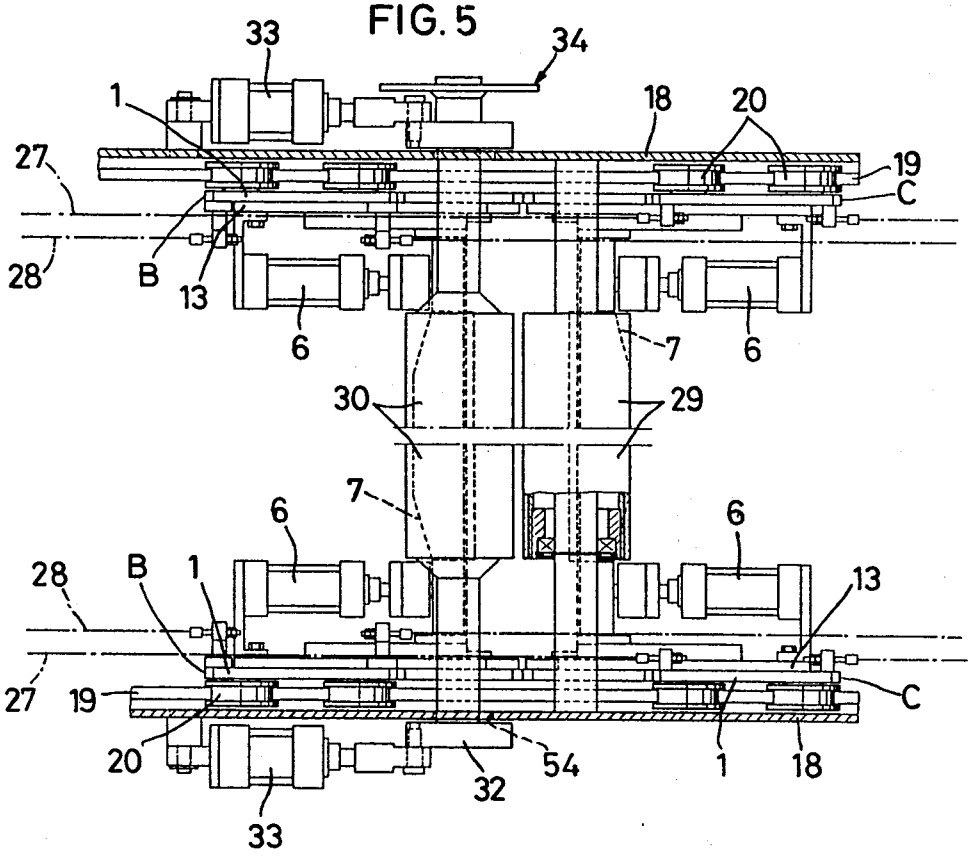
FIG. 5 is a horizontal sectional plan view of the same.
Figure 6:
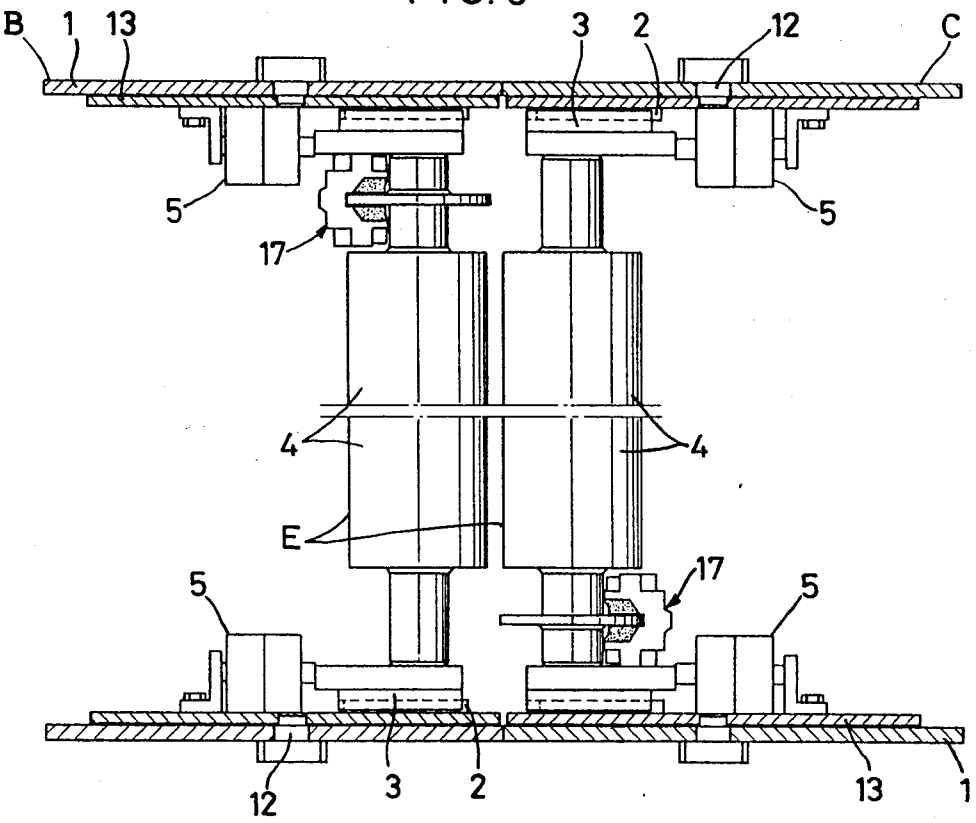
FIG. 6 is a horizontal sectional plan view showing the brake rolls.
Figure 7:
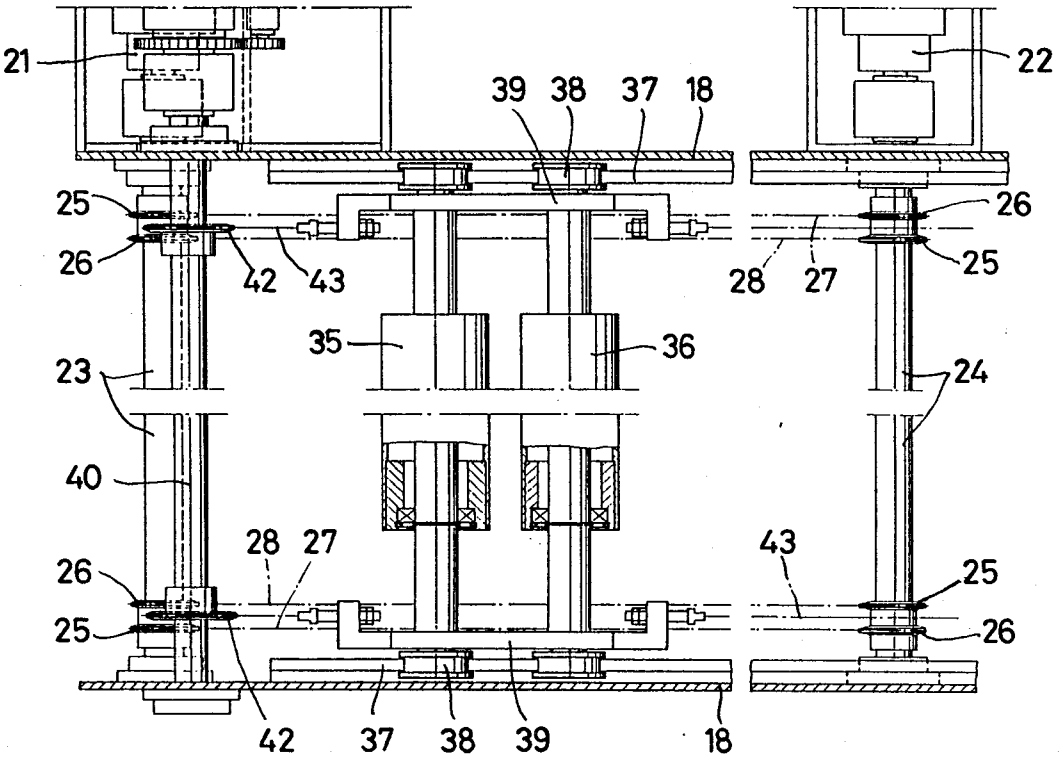
FIG. 7 is a horizontal sectional plan view showing the accumulator rolls.
Figure 8:
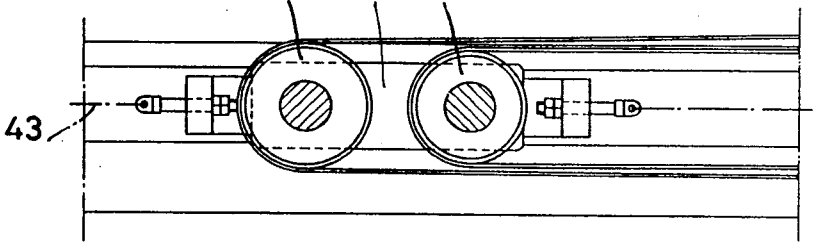
FIG. 8 is a vertical sectional side view of the same.

The left and right units B and C are moved by the following mechanism. (FIGS. 5–7) Rails 19 extend along the side plates 18 between the ends thereof. Wheels 20 mounted on the inner plate 1 roll on the rails 19. Two shafts 23 and 24 extend between the side plates 18 and are rotatably driven by motors 21 and 22, respectively. A free sprocket 25 and a fixed sprocket 26 are mounted on each shaft at each end thereof. The former freely turns and the latter turns together with the shaft. Chains 27 and 28 pass around the respective pairs of free sprocket 25 and the pairs of fixed sprockets 26. The left unit B is secured to the chain 28 and the right unit C is secured to the chain 27.

Above the press members 7 on the left and right units, there are provided two splice rolls 29 and 30, at least one of which is movable toward and away from the other. (FIG. 2) One splice roll 29 is rotatably mounted on the side plates 18 whereas the other splice roll 30 is mounted on a pivotal plate 32 having its top end pivoted on the side plate 18 so as to swing around a pin 31. A cylinder 33 causes the pivotal plate 32 to pivot, thereby pressing the splice roll 30 against the splice roll 29. On the splice roll 30 is shown as being provided with a disc brake 34, but both of the splice rolls may be provided with such a brake.

Between the side plates 18 above the rail 2, two accumulator rolls 35 and 36 (FIG. 7) are provided so as to extend between the ends of the side plates 18. In the embodiment, these rolls extend through slide plates 39 and have wheels 38 rolling on rails 37 which extend from one end of the side plates 18 to their other end.

At each end of the side plates 18, rotary shafts 40 and 41 extend between the side plates 18. A sprocket 42 is mounted on each end of the rotary shafts 40 and 41. A chain 43 passes around each pair of the sprockets 42. The ends of each chain 43 are secured to each end of the corresponding slide plate 39 of the accumulator rolls.

Figure 9:
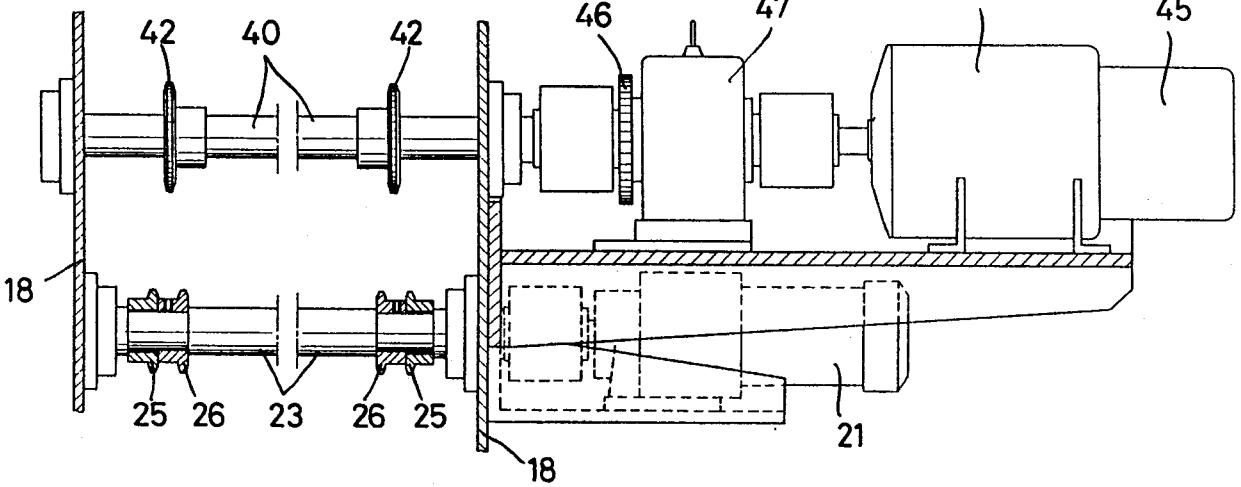
FIG. 9 is a vertical sectional front view of the mechanism for driving the left and right units and the accumulator rolls.
Figure 10:
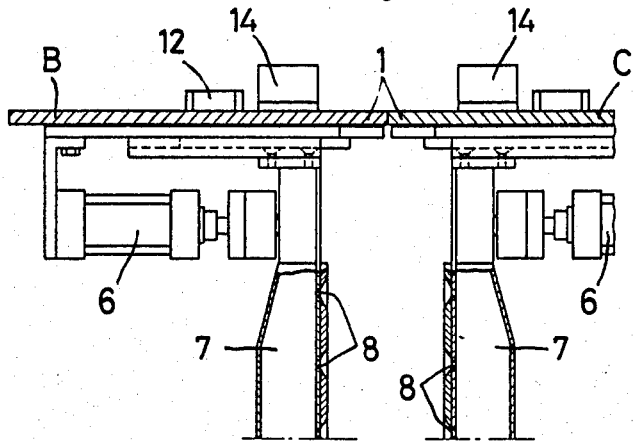
FIG. 10 is a horizontal sectional plan view of the press member and related parts.

A motor 44 (FIG. 9) is connected to the rotary shaft 40 at the end opposite to the end toward which the web runs. The motor 44 drives the rotary shaft 40 to move the accumulator rolls 35 and 36 toward the rotary shaft. When they return to their normal position, a detector 49 such as a limit switch will operate to stop the motor 44. The motor is provided with a brake 45, a gear 46, and a reduction gear 47. The motor 44 is actuated by a detector 50 such as a limit switch which operates when the accumulator rolls 35 and 36 arrive at a point adjacent to the rotary shaft 41.

Three guide rolls 51, 52 and 53 are provided (FIG. 25) between the side plates 18 on the left of the rotary shaft 41 with the first one 51 below the second one 52 and the third one 53 at a level between the first one and the second one.

Although in the embodiment one of the splice rolls is provided with a brake to stop the running web, brake rolls or any other web clamp may be provided between the splice rolls 29 and 30 freely rotating and the press members 7 for the same purpose.

The numeral 54 designates slots formed in the side plates 18 to receive the shaft of the splice roll 30. The numeral 55 designates a stop by which the stop position is decided when the swivel plate 13 is pivoted.

The overall operation will be described below.

The web P will first be considered as running from a roll supported at one side of the mill roll stand A around the brake roll 4 in the right unit C which is at a standstill over the mill stand, over the splice roll 29, the first guide roll 51, the accumulator roll 35, the second guide roll 52, the accumulator roll 36, and the third guide roll 53, and to a preconditioner D (FIG. 1) from which the web is supplied to the next station.

When the accumulator rolls 35 and 36 are at a standstill near the rotary shaft 40 as shown in FIG. 1, a considerable length of the running web P is accumulated.

While the web P is being supplied, a new web roll is set on the other arm of the mill stand A.

Figure 13:
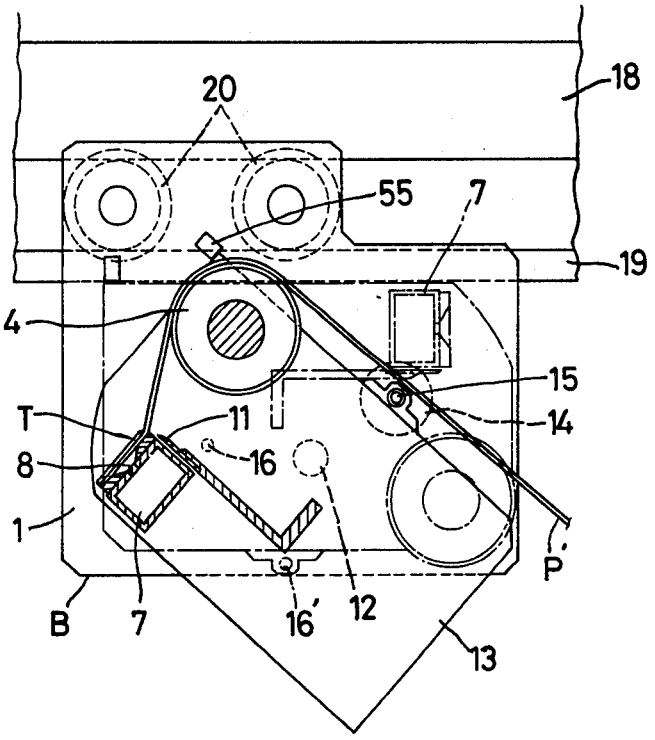
FIG. 13 is a vertical sectional side view showing the left unit tilted counterclockwise.
Figure 14:
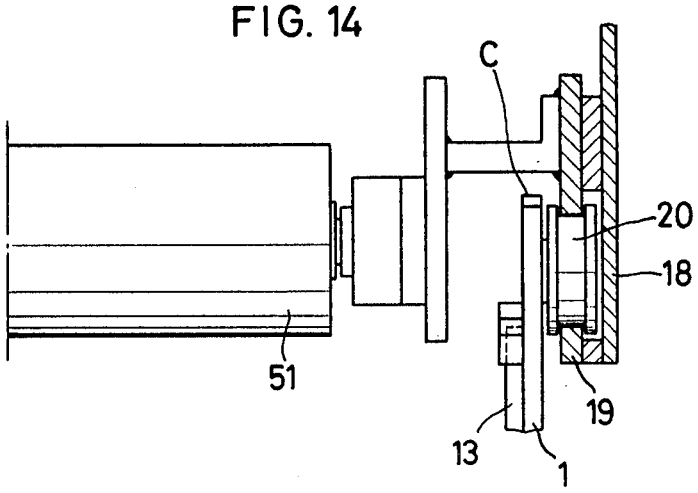
FIG. 14 is a vertical sectional front view showing the guide roll.

By starting the motor 21, the left unit B is backed toward the rotary shaft 40 (to the position shown in FIG. 1 by a dotted line). The cylinder 14 is actuated to move the pin 15 out of the hole 16 to allow the swivel plates 13 to swing to a counterclockwise position (FIG. 13). Thereafter, the pin 15 is put in the hole 16' by means of the cylinder 14.

The standby web P' is pulled out of the new roll and is brought around the brake roll 4 of the left unit B and over the suction holes 8 in the press member 7. The leading end of the web is held on the press member by suction from the pump 48.

A double-sided adhesive tape T is applied to the upper surface of the end of the new or standby web P' over its entire width. The tape T used is of such a width that its one edge is aligned with the leading edge of the new web and its other edge will be just above the cutter 11.

After the end of the new web has been set on the press member 7, the swivel plates 13 carrying the associated members are pivoted clockwise to their original position and locked therein by putting the pin 15 in the hole 16.

The left unit B now carrying the new web P' is advanced by the chain 28 until its inner plate 1 abuts against the inner plate of the right unit C. At this time, the brake roll 4 in the left unit B and the splice roll 30 are retracted beforehand by means of the cylinders 5 and 33, respectively.

This completes the preparation of the standby web P'.

Although in this embodiment the end of the new web is supported by suction, it may be held on the press member 7 with a double-sided adhesive tape having a weaker adhesive force than the adhesive tape T.

Next, it will be explained how the standby web P' from the new roll is spliced to the running web P just before the old web roll is used up.

Figure 15:
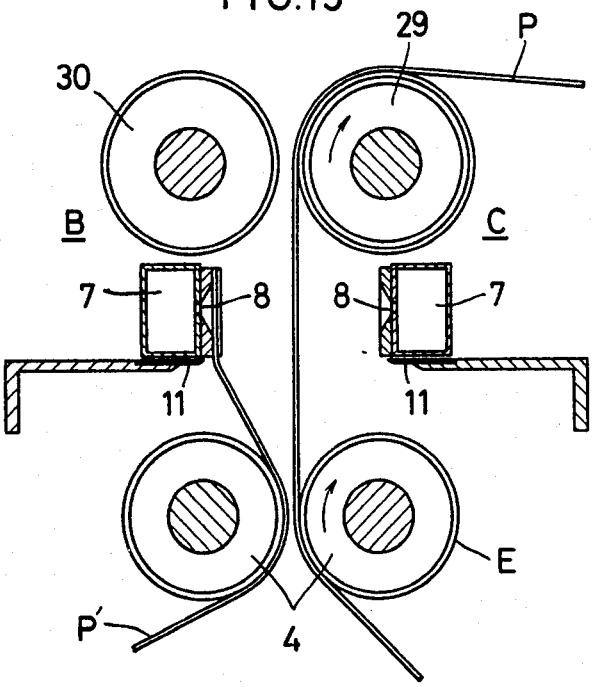
FIGS. 15–23 are vertical sectional side views showing how the new web is spliced to the old web.
Figure 16:
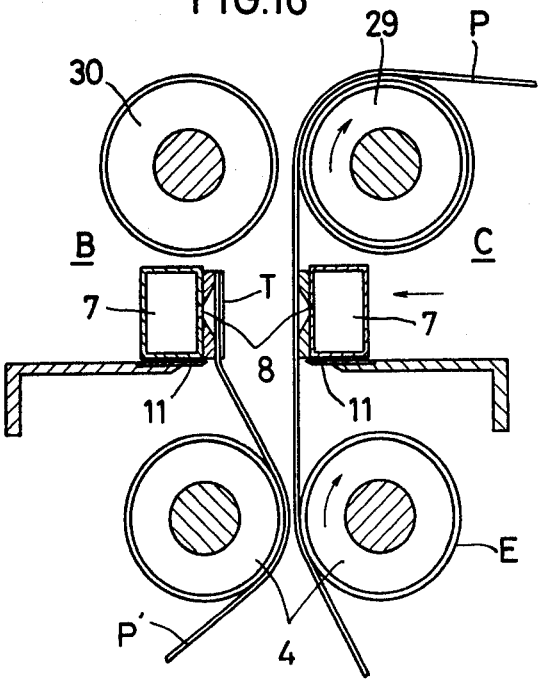

The press member 7 together with the cutter 11 of the right unit C is advanced by the cylinders 6 to their operative position where the front surface of the press member touches the running web P. (FIGS. 15–16) Even if the pump 48 is turned on to apply suction, the running web P will keep sliding along the front surface of the press member 7.

Figure 17:
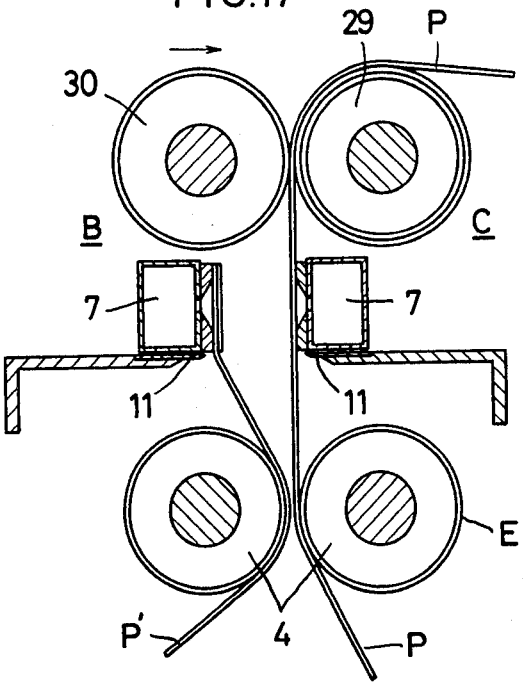

Then, the cylinder 33 is actuated to pivot the pivotal plate 32 counterclockwise in FIG. 2, thereby pressing the splice roll 30 (braked by the disc brake 34) against the splice roll 29 (FIG. 17) to stop the running web P.

Because even after the running web has been stopped the supply of the web through the preconditioner D to the next station is not stopped, a large tension will be applied to the running web P downstream of the splice rolls 29 and 30, thus moving the accumulator rolls 35 and 36 toward the rotary shaft 41. As they move in that direction, the amount of the accumulated web will decrease gradually. However, the amount of accumulation is sufficient to allow the splicing of the new web to the old web without stopping the supply of the web to the next station.

Figure 18:
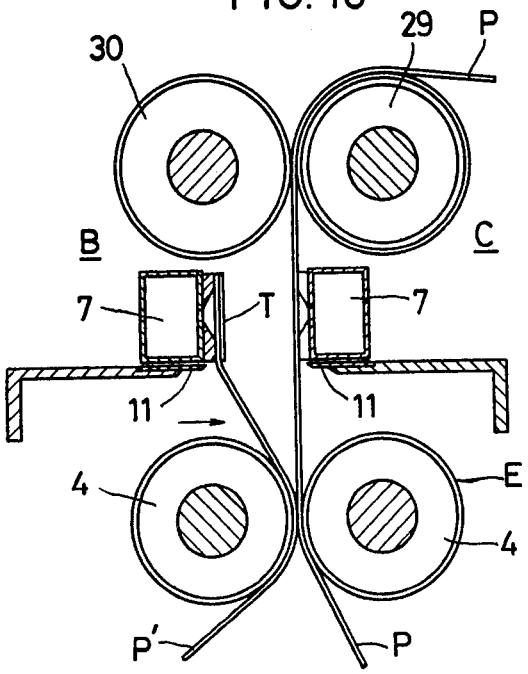

After the splice roll 30 has been pressed against the splice roll 29, the cylinder 5 is actuated to press the brake roll 4 of the left unit B against that of the right unit C (FIG. 18). These brake rolls 4 are braked by the disc brakes 17. Now the old web P is tight between the splice rolls 29 and 30 and the brake rolls 4.

Figure 19:
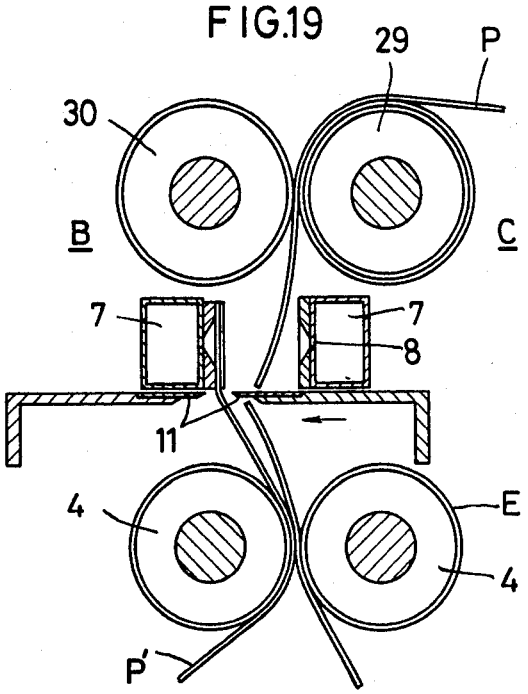
Figure 20:
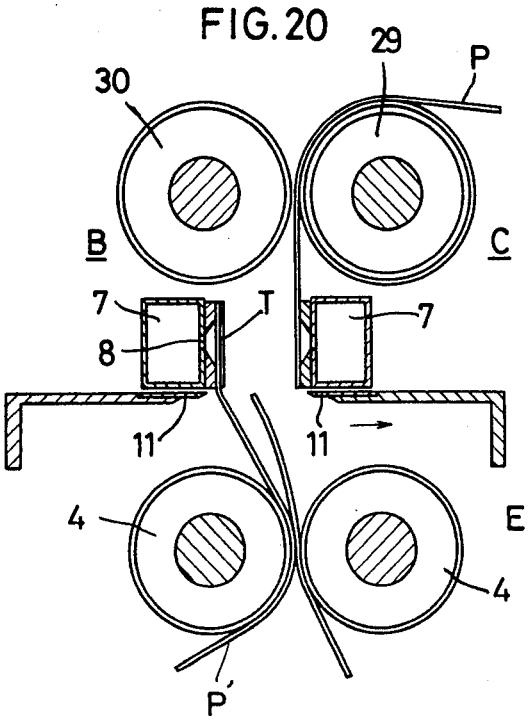

The cylinder 10 is then actuated to advance only the cutter 11 of the right unit C so that the old web P will be cut between the splice rolls and the brake rolls. (FIG. 19) After cutting, the cutter 11 retracts. (FIG. 20) Even though the cut end of the old web comes away from the press member 7 just after cutting as in FIG. 19, it will be soon sucked by air against the press member as in FIG. 20.

Figure 21:
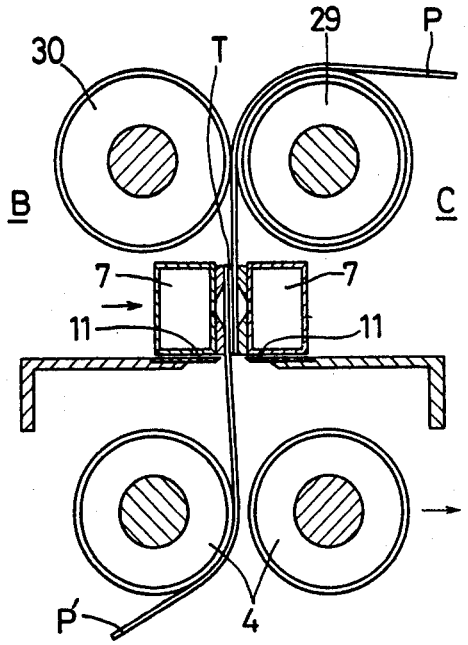

The cylinder 6 is actuated to press the press member 7 of the left unit B against that of the right unit C (FIG. 21) to splice the leading end of the standby web P' to the cut end of the old web P with the adhesive tape T.

Simultaneously with the splicing both of the brake rolls 4 are released from braking and the cylinder 5 is actuated to retract the brake roll 4 of the right unit C.

Figure 22:
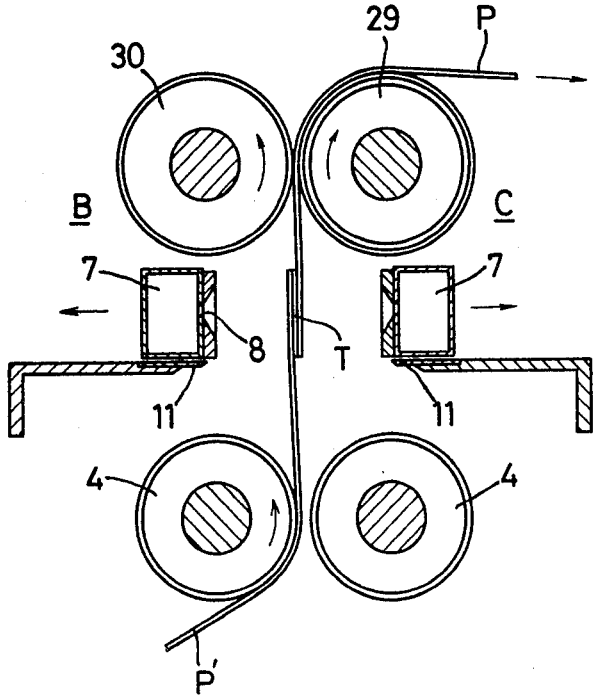
Figure 23:
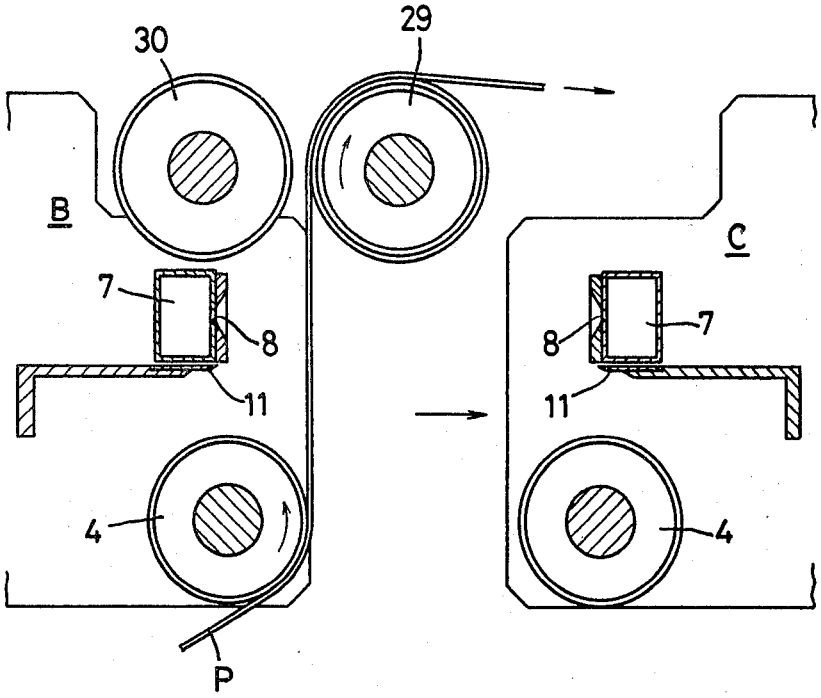

After adhesion of the new web to the old web, the pump 48 is turned off and the press members 7 and the cutter 11 of both units B and C are retracted. (FIG. 22) The splice roll 30 is released from braking by its disc brake 34 and the pressure by the cylinder 33 against the roll 29 is reduced. Now the spliced web can start running. The spliced point is nipped between the splice rolls 29 and 30 so that the adhesion is ensured. The splice roll 30 is then retracted to its inoperative position. (FIG. 23)

Figure 25:
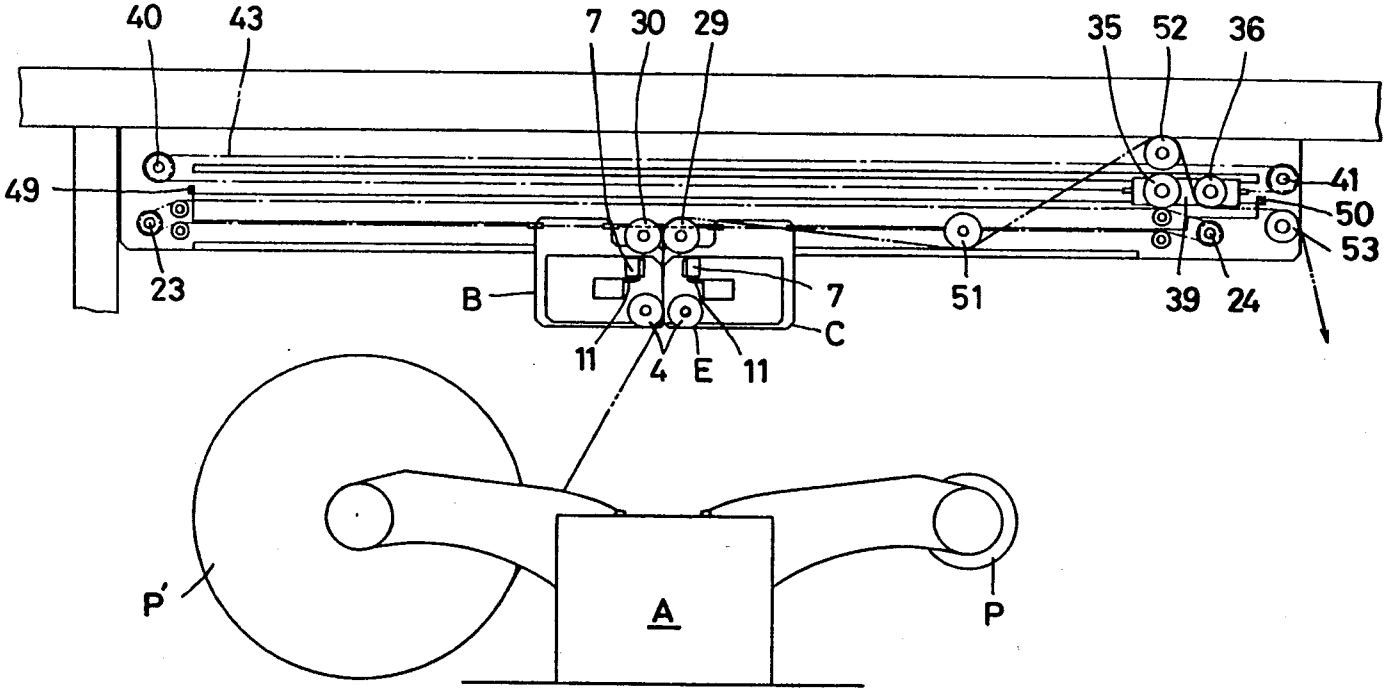
FIGS. 25 and 26 are side views showing how the accumulator rolls move.
Figure 26:
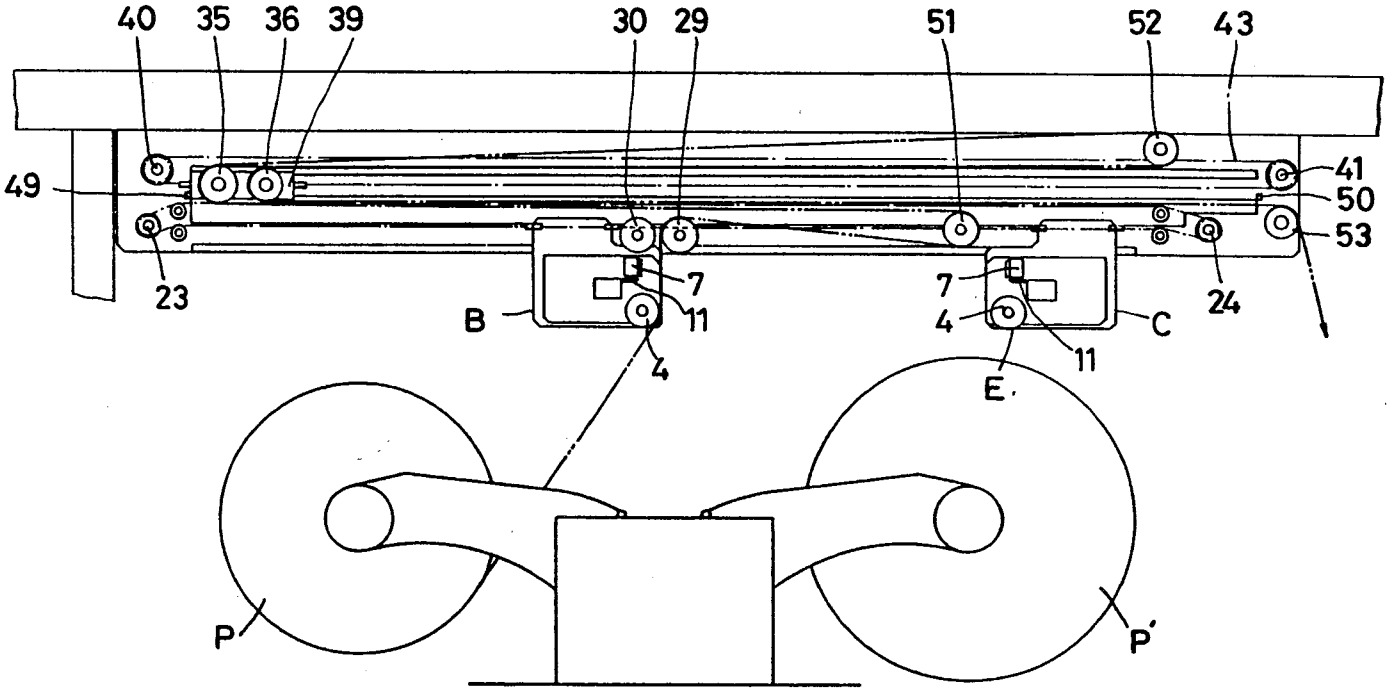

As shown in FIG. 25, when the splicing is complete, the amount of the accumulated web will almost run out with the accumulator rolls 35 and 36 coming near the rotary shaft 41. When the slide plate 39 abuts the detector 50, the latter will actuate the motor 44 so that the chain 43 will be driven to move the accumulator rolls 35 and 36 toward the rotary shaft 40. When these rolls 35 and 36 come back to position near the rotary shaft 40, the slide plate 39 abuts the detector 49 (FIG. 26), which actuates the brake 45 to stop the motor 44.

When another new roll is set on the mill stand and the web from the new roll is prepared for the next splicing, the right unit C is moved away from the left unit B to the position shown in FIG. 1 by the dotted line.

Figure 24:
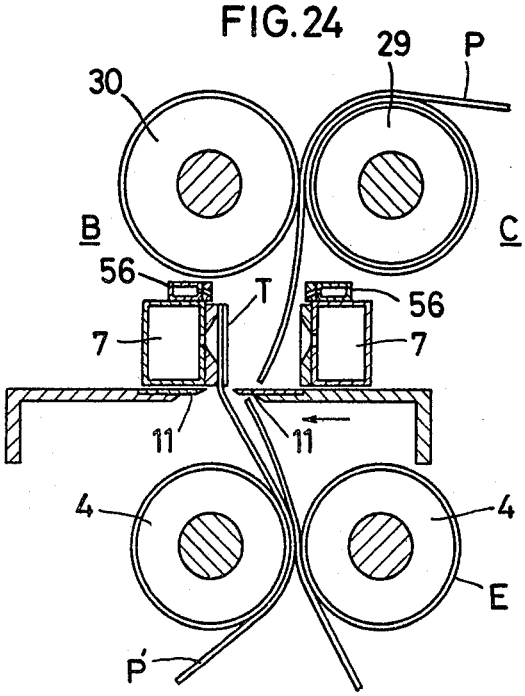
FIG. 24 is a view similar to FIG. 19 but with the air injection nozzle provided.

Preferably, an air injection nozzle 56 (FIG. 24) may be provided on each press member 7 to jet air toward the cut end of the web (in FIG. 24 from the nozzle at the lefthand side), thereby preventing it from curling. This ensures that splicing is done neatly with the cut end straight.

Next, another embodiment for web splicing will be described with reference to FIGS. 27–33.

The front surface of each press member 7 is straight at its upper half but inclined at its lower half so that the distance between the opposed front surfaces will increase toward the bottom. A plurality of suction holes 8 are provided in the inclined surface.

Firstly, the end of the web P' from the standby roll is supported on the press member 7 by suction and a double-sided adhesive tape T is applied to its end over the entire width of the web.

Figure 27:
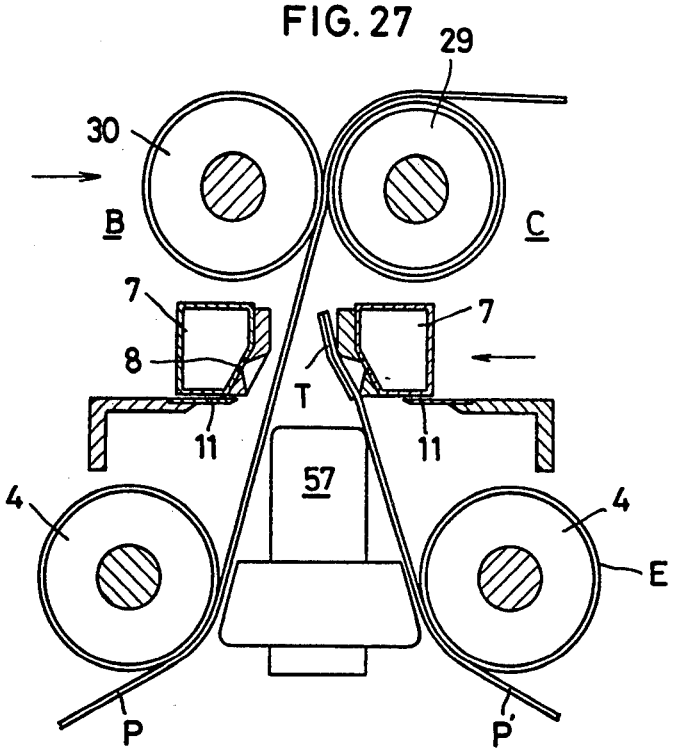
FIGS. 27–33 are vertical sectional side views showing how the webs are spliced in another embodiment of the web splicing method.
Figure 28:
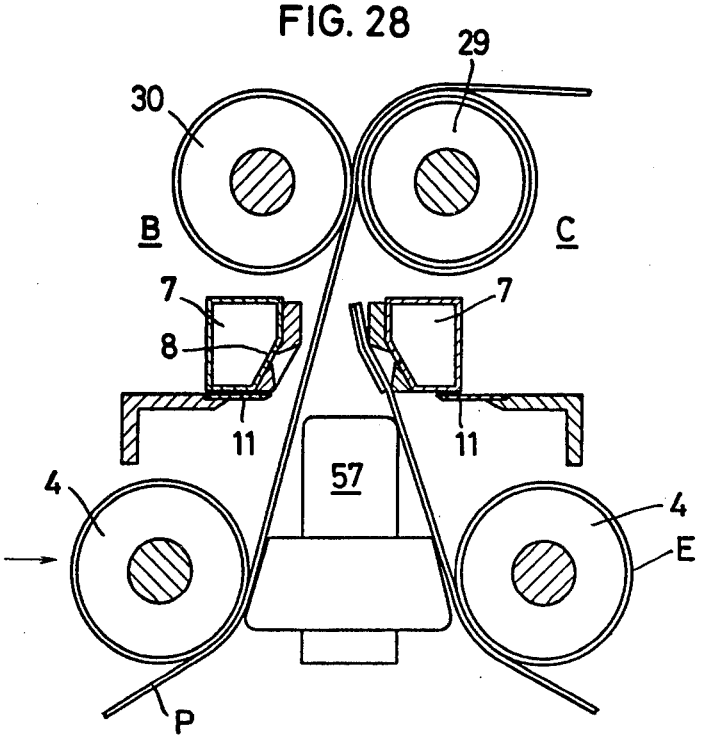

The press member 7 of the right unit C is advanced and the splice roll 30 is pressed against the splice roll 29 to stop the running web P (FIG. 27). Also, the brake roll 4 of the left unit B is pressed against a stationary body 57 to ensure that there is no looseness in the web P. (FIG. 28)

Figure 29:
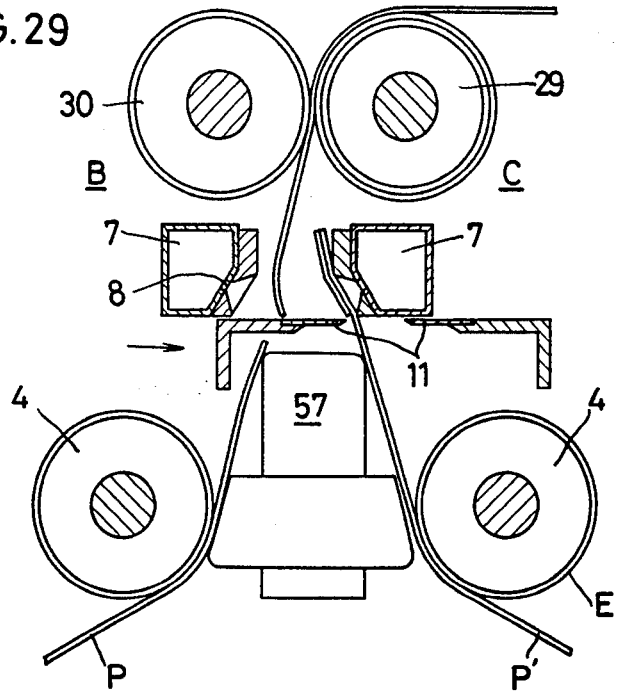
Figure 30:
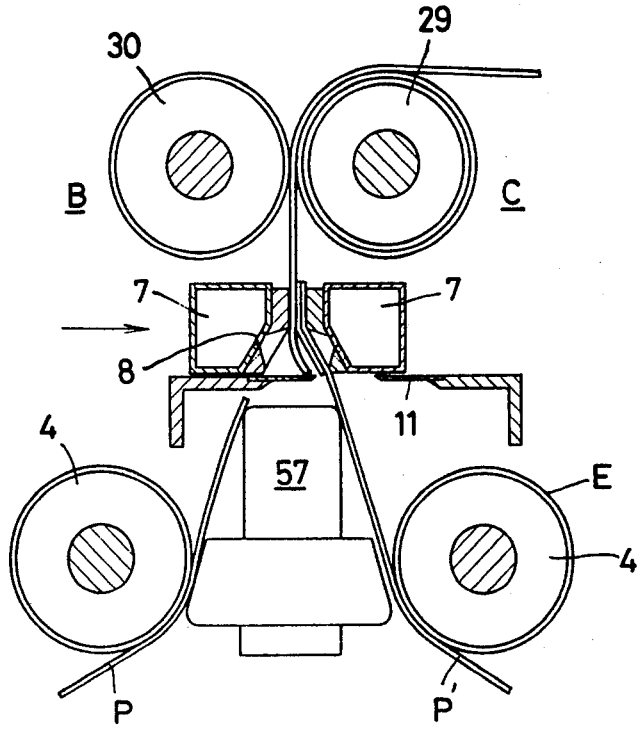

The cutter 11 of the left unit B is advanced to cut the web P (FIG. 29). Because the web is tight, a clean cut can be made.

The press member 7 of the left unit B is pressed against that of the right unit C (FIG. 30) to splice the end of the standby web P' to the cut end of the running web P. Since the press members are inclined at the lower half of their front, the standby web is kept away from the cutter. Further, some length of the web near the cut point is left loose, i.e. not adhered. This prevents the cut end from being adhered if it is curled or otherwise deformed.

Figure 31:
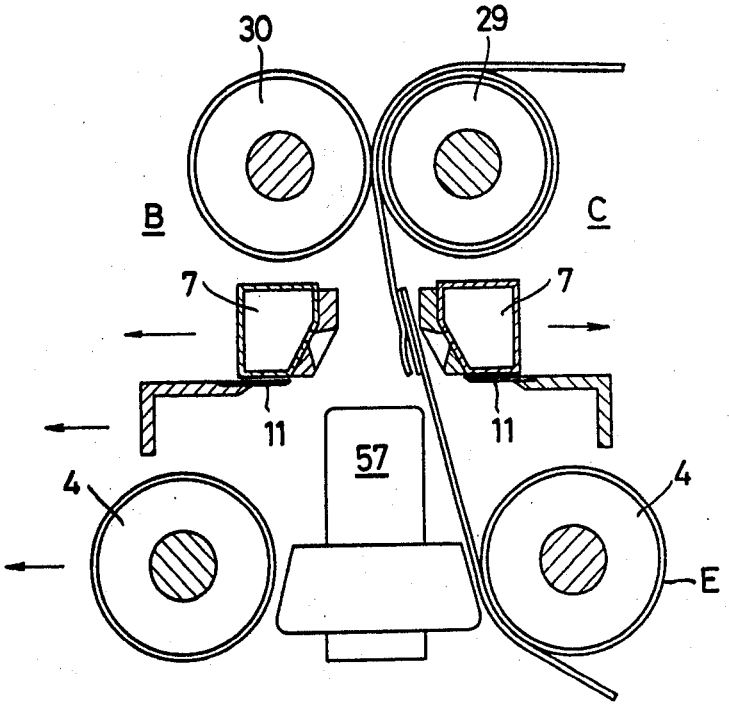
Figure 32:
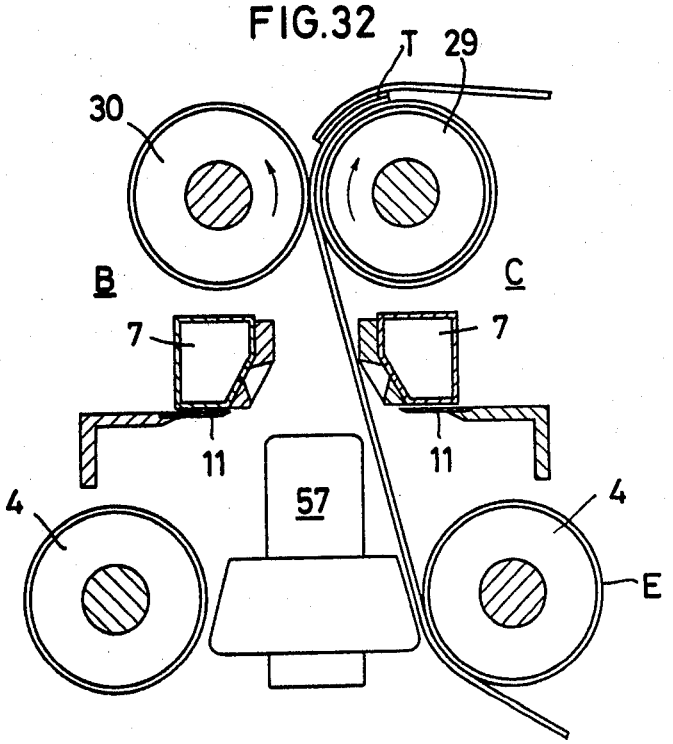

The cutter 11, the press member 7 and the brake roll 4 of the left unit B and the press member of the right unit C are retracted. (FIG. 31)

Figure 33:
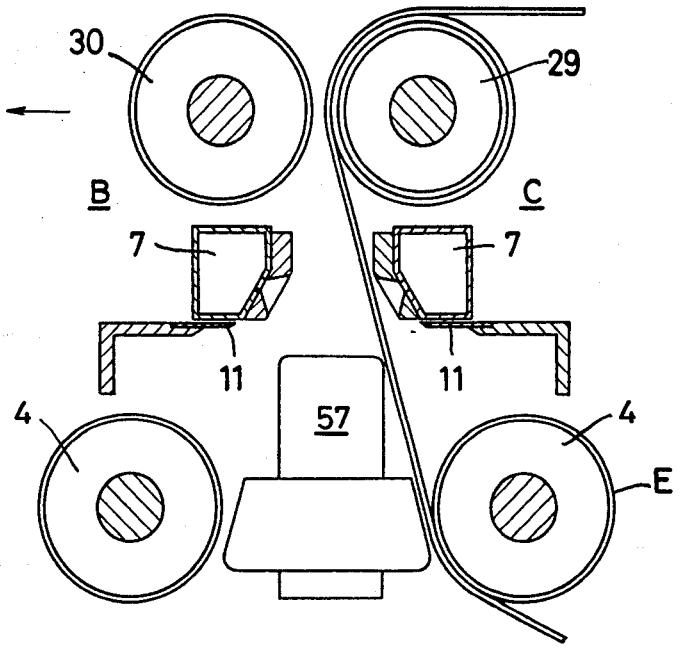

The splice roll 30 is released from braking by the disc brake 34 and slightly retracted by the cylinder 33 away from the splice roll 29. Now the spliced web will again start running. (FIG. 32) The spliced point is nipped between the splice rolls 29 and 30 so that the adhesion of the new web to the old web is strengthened. The splice roll 30 is then retracted to its inoperative position. (FIG. 33)

Figure 34:
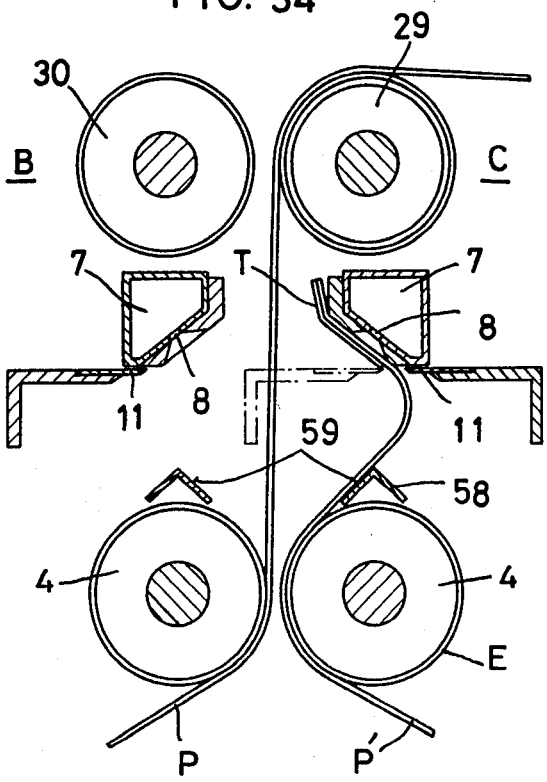
FIGS. 34 and 35 are vertical sectional side views showing other embodiments.

A bar 58 with pins 59 may be provided above each brake roll 4 so as to be parallel thereto to engage the standby web P' with the pins 59. (FIG. 34)

Figure 35:
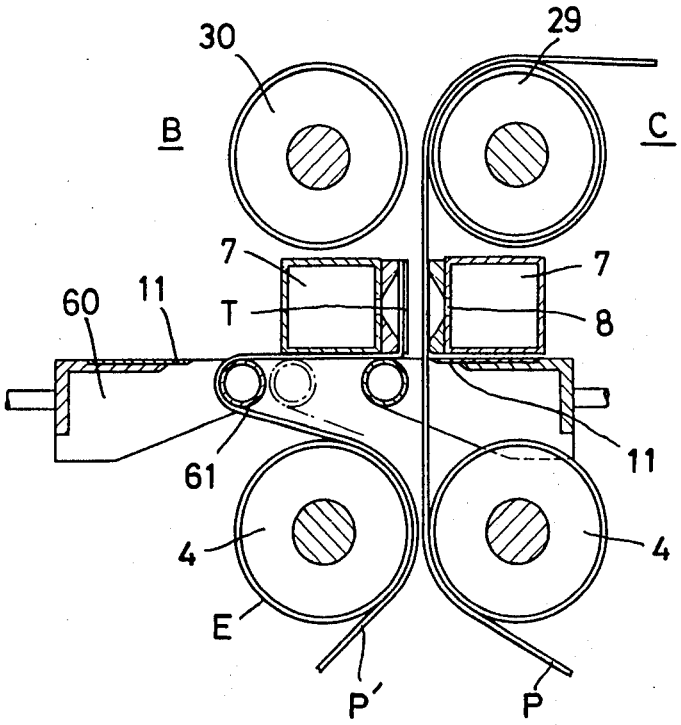
Figure 36:
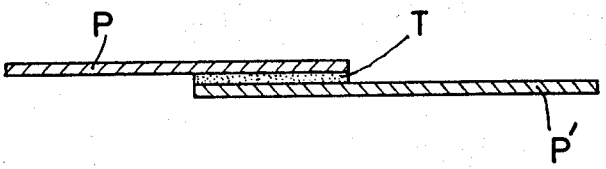
FIG. 36 is an enlarged view showing how the standby web is spliced to the running web.

A guide 61 such as a pipe may be mounted across arms 60 extending from a base for mounting each cutter 11 to guide the standby web away from the cutter 11 at the opposite side, thereby preventing it from being cut by the cutter which is provided to cut the running or old web. (FIG. 35)

Although in the preferred embodiments a double-sided adhesive tape is used to splice the new web to the old web, any other adhesive means may be used. For example, an adhesive may be applied to the leading edge of the new web held in position for splicing.

It is to be understood that various changes or variations may be made within the scope of the present invention.

What are claimed are:

1. A method for splicing the leading end of a standby web to a running web being continuously supplied from a roll, comprising the steps of:

holding the leading end of the standby web adjacent a splice point at which the webs are to be spliced together and in position for splicing, the leading end having adhesive means applied to one surface of the leading end of the standby web along the leading edge thereof;

stopping the running web by gripping it between two rolls, at least one of which has a brake which is applied to brake said one roll at a point behind, relative to the direction of movement of the web, the splice point;

clamping the running web at a point ahead of, relative to the direction of movement of the web, the splice point so that the web is held taut between the point ahead and the point behind;

cutting the taut running web between said gripping and clamping points and at a position corresponding substantially exactly to the end of the splice which is toward the clamping point;

then splicing the leading end of the standby web to the running web by pressing the cut end portion of the running web including the portion immediately adjacent the cut against the held leading end of the standby web with said adhesive means therebetween; and releasing the braked one roll for releasing the spliced web from the gripping and clamping thereof to permit it to start running.

2. The method as claimed in claim 1 wherein the leading end of the standby web is held in position for splicing by suction force.

3. The method as claimed in claim 2 further comprising applying suction force to said running web at said splice point.

4. The method as claimed in claim 1 wherein said running web is clamped by engaging it between one pair of rolls while braking at least one roll of said pair of rolls.

5. The method as claimed in claim 1 wherein said running web is clamped by pressing it against a stationary body by a braked roll.

6. The method as claimed in claim 1 further comprising, after the running web has been cut, blowing air toward the cut end thereof to prevent it from curling.

7. The method as claimed in claim 1 wherein said standby web and said running web are held for splicing in two oblique planes relative to the running web, the distance therebetween increasing in the direction opposite the direction in which the web is running.

8. An apparatus for splicing the leading end of a standby web to a running web being continuously supplied from a roll and running along a wet path, comprising:

a pair of stop rolls on opposite sides of the web path, at least one of which is movable toward and away from the other and at least one of said rolls having a brake for, when said stop rolls are being pressed against each other, stopping the running web for splicing;

web clamp means disposed along the web path at a point spaced from said web stop rolls in a direction opposite the direction in which the web moves along the web path, and being for clamping the running web when it is stopped and holding the web taut between said stop rolls and said web clamp means;

a pair of press members provided between said stop rolls and said web clamp means on opposite sides of the web path and having means for holding the end of the standby web thereon and press member moving means for relatively moving said press members toward and away from each other for splicing the standby web to the running web when said press members are moved toward each other and pressed against each other with said webs and an adhesive means therebetween; and at least one cutter on the side of said web path corresponding to the running web, provided on the side of the corresponding press member toward said web clamping means, cutter moving means connected to said cutter for moving said cutter toward and away from the web and operable to move said cutter toward the running web to cut the running web prior to the operation of said press member moving means to press said press members against each other, said cutter being in a position such that when it is advanced toward the web path, it will cut the running web at the end of the corresponding press member which is toward said clamp means.

9. An apparatus as claimed in claim 8 wherein said web clamp means comprises a pair of brake rolls mounted on opposite sides of the web path and movable toward and away from each other, at least one of said brake rolls having a brake.

10. An apparatus as claimed in claim 8 wherein said press members are hollow and having a suction hole in the front surface thereof, and means connecting said press members to a vacuum source.

11. An apparatus as claimed in claim 8 further comprising an air injection nozzle adjacent said press members and directed for blowing air toward the cut end of the running web to prevent it from curling.

12. An apparatus as claimed in claim 8 wherein said web path extends vertically between said stop roll and said clamp means, and said press members each have a front surface which has a vertical upper part and an outwardly tapered lower part tapering away from the opposite press member, and said web clamp means comprises a pair of brake rolls each having a brake and mounted on opposite sides of the web path and movable toward and away from each other and a stationary body disposed between said brake rolls against which said brake rolls are pressed to clamp said running web.

* * * * *